US005277323A

United States Patent [19]

Wallace et al.

[11] Patent Number: 5,277,323

[45] Date of Patent: Jan. 11, 1994

[54] LOCKING WEDGE ASSEMBLY TO REMOVABLY SECURE A MALE CONNECTION MEMBER IN AN ARTICULATED-TYPE COUPLING ARRANGEMENT

[75] Inventors: William D. Wallace, Chicago, Ill.; Edward G. Lynch, Jr., Saugus, Calif.; David W. Daugherty, Jr., Bolingbrook, Ill.; Wajih Kanjo, Lockport, Ill.; Michael G. Hawryszkow, Munster, Ind.

[73] Assignee: Westinghouse Air Brake Company, Wilmerding, Pa.

[21] Appl. No.: 814,259

[22] Filed: Dec. 23, 1991

Related U.S. Application Data

[63] Continuation-in-part of Ser. No. 588,454, Sep. 26, 1990, abandoned.

[51] Int. Cl.[5] ..... B61G 5/02

[52] U.S. Cl. ..... 213/62 R; 213/75 R; 105/3; 403/374; 403/379

[58] Field of Search ..... 213/188, 192, 208, 75; 403/154, 157, 158, 374, 379; 105/3, 4.1, 5; 280/511; 180/134

[56] References Cited

U.S. PATENT DOCUMENTS

| | | | |
|---|---|---|---|
| 1,473,061 | 5/1921 | Thomas | 403/154 X |
| 3,915,469 | 10/1975 | Vanice | 403/154 X |
| 4,258,628 | 3/1981 | Altherr | 105/4 R |
| 4,593,829 | 6/1986 | Altherr | 213/75 R |
| 4,684,280 | 8/1987 | Dirkin et al. | 403/157 |
| 4,867,071 | 9/1989 | Weber | 213/7 X |
| 5,042,393 | 8/1991 | Kanjo et al. | 105/3 |

OTHER PUBLICATIONS

Maintenance Manual for ASF Articulated Connection Assembly.

*Primary Examiner*—Robert J. Oberleitner
*Assistant Examiner*—Lee W. Young
*Attorney, Agent, or Firm*—J. O. Ray, Jr.

[57] ABSTRACT

This invention provides a locking wedge assembly capable of exerting a predetermined pressure in at least one direction. Such assembly removably secures a male connection member to a female connection member of an articulated coupling arrangement. Such articulated coupling arrangement used to secure one end of a first railway car to an adjacent end of said railway car in a semi-permanent fashion. The assembly includes a wedge-shaped member having a surface engageable with a surface located in an opening in a side wall portion of a cavity at an outer end of the female member and another surface engageable with a surface on a shaft member of a spherical bearing carried by such male member. An aperture is formed through such wedge-shaped member along a longitudinal axis thereof. A bolt member is disposed through this aperture and an aperture formed through a bottom wall on the outer end of such female member adjacent the side wall opening. At least one force exerting device is positioned intermediate either the top surface of the wedge member and the bottom surface of the head of such bolt on the bottom surface of the bottom wall and the top surface of the nut carried by the bolt.

20 Claims, 1 Drawing Sheet

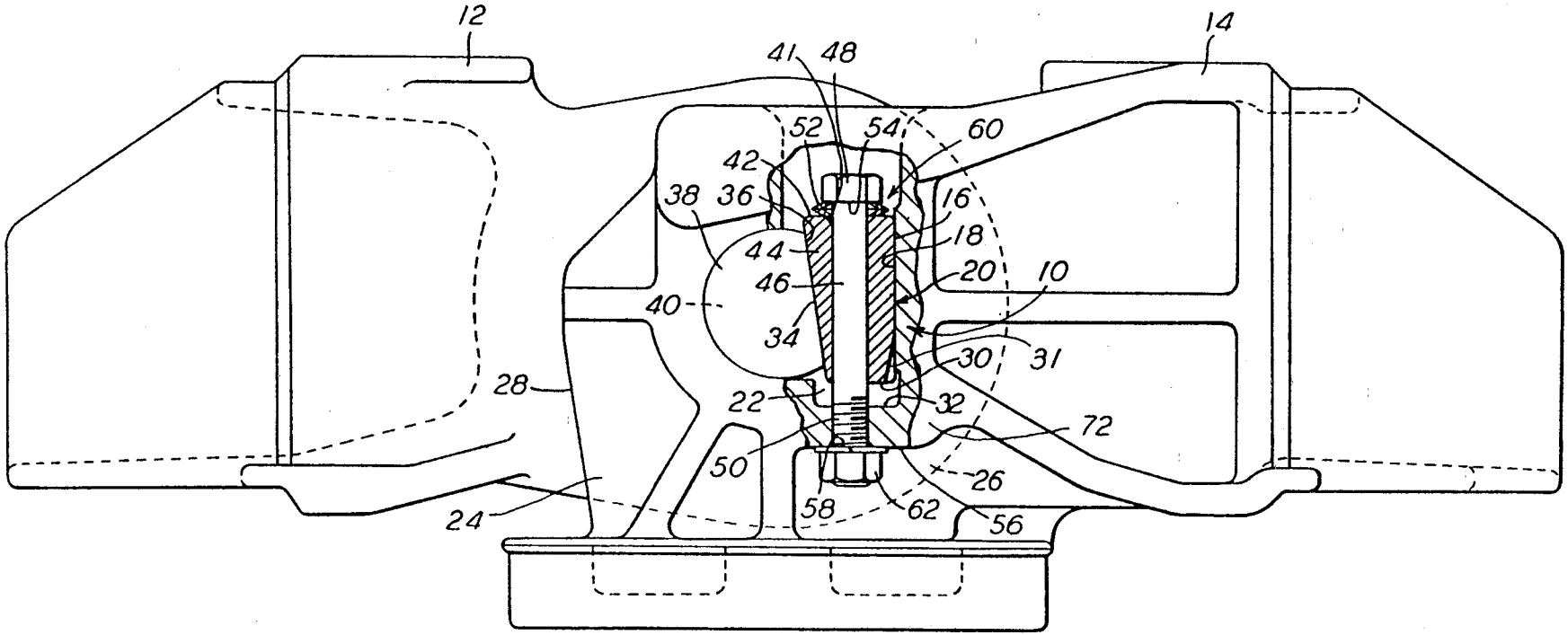
14
12
10
16
18
20
30
31
32
34
36
38
40
41
42
44
46
48
50
52
54
56
58
60
62
22
24
26
28
72

LOCKING WEDGE ASSEMBLY TO REMOVABLY SECURE A MALE CONNECTION MEMBER IN AN ARTICULATED-TYPE COUPLING ARRANGEMENT

This is a continuation of application Ser. No. 07/588,454 filed Sept. 26, 1990 now abandoned.

FIELD OF THE INVENTION

The present invention relates, in general, to articulated-type coupling arrangements used to connect one end of a first railway car to an adjacent end of second railway car in a substantially semi-permanent fashion and, more particularly, this invention relates to a locking wedge assembly which is capable of exerting a predetermined force in at least one direction and is used to removably secure the male connection member to the female connection member in an articulated coupling arrangement.

BACKGROUND OF THE INVENTION

Prior to the development of the present invention, it is well known in today's modern railroad industry that couplers are used to connect adjacently disposed ends of a pair of railway cars together. Further, on any of these railway cars which may possibly be used in interchange type service, these standard couplers must have received approval by the Association of American Railroads (AAR) prior to their being installed on such adjacently disposed ends of the railway cars.

It is generally well recognized, in the railroad industry, that such couplers will normally be required to serve a number of functions in this application. For example, standard couplers are used to facilitate the connection and the unconnecting of individual railway cars to and from, respectively, a train consist. Another function served by these standard couplers is that they enable such individual railway cars to more easily negotiate the curved portion of the track which will be encountered during operation of the train on the track structure. Additionally, such standard couplers perform the function of allowing such railway cars to be more easily and readily combined, thereby making up a train consist. These standard couplers further permit such adjacent ends of the railway cars to be easily and readily separated into individual cars as necessary for either loading or unloading cargo thereto or therefrom, respectively.

In more recent times, however, in the railroad industry it has come to be generally recognized that a significant number of relative important advantages can be achieved by the interconnection of a number of railway cars to form a substantially semi-permanent unit. This has been particularly the situation, for example, where such railway cars are specifically designed for use in what is commonly referred to in the railroad industry as "piggyback" or intermodal service. One of the primary reasons for this is that the cargo which is to be either loaded or unloaded is either brought to or removed from, respectively, predetermined central locations. Generally, such central locations are usually owned and operated by the railroads. This cargo is normally either over-the-road trailers or large containers which usually are used to ship cargo by oceangoing vessels.

The individual railway cars which have been connected together in this substantially semi-permanent manner are commonly known in the railroad industry as either a "5-pack" or as a "10-pack". Except at the extreme outermost ends of each 5 or 10-pack unit, the use of such standard couplers discussed above is not required on these 5 or 10-pack units. Because of their dedicated service, these 5 or 10-pack units will generally only be broken apart on a periodical basis. This is the primary reason why such standard couplers are not required in this particular application. In most cases, for example, the breaking of these 5 or 10-pack units will normally only occur only when some maintenance must be carried out on either an individual coupler component or on certain other critical components positioned on the railway car which will require an individual car to be removed from such 10-pack unit on a temporary basis. In the railroad industry, it has become quite obvious that with the use of some type of semi-permanent coupling arrangement it is possible for them to achieve a rather significant reduction in their operating and maintenance costs. These cost reductions can be attributed to a variety of reasons. At a minimum, these reasons include a significant reduction in the weight of the railway equipment. Such weight reduction results in a rather significant reduction in the amount of energy required to move a train consist over the track structure. Because in this semi-permanent coupling arrangement fewer railway trucks are required, there is not only a reduction in equipment costs achieved but this also results in a reduction of the maintenance requirements.

Now, however, with the relatively extensive use of such substantially semi-permanent coupling arrangement, the railroad industry in conjunction with the railway equipment suppliers have determined that it is of critical importance for a close-buttoned relationship to be maintained between the couplers draft components present in a particular coupling arrangement. Further contributing to the importance of this close-buttoned relationship requirement is the ever increasing loads which must be carried by modern railway cars and train consists in order for the railroads to be competitive. This close-buttoned relationship has been found necessary, for example, so that the detrimental effects of the impact forces which are normally encountered during in-track train operation can be reduced to an acceptable level. In this manner, the possible damage that could be incurred by the cargo and/or the railway equipment can be held to an absolute minimum. Such impact forces are generally encountered during normal buff operation of the train consist.

With the above discussion in mind, attention is now directed to a particular prior art type articulated coupling arrangement used for the purpose of connecting adjacent ends of a pair of railway cars together in such semi-permanent fashion. This prior art articulated coupling arrangement is taught in U.S. Pat. No. 4,258,628. As has been illustrated therein, this particular articulated coupling apparatus includes a male connection member and a female connection member. The male connection member is secured at one end thereof to one end of a first railway car body member and the female connection member is secured at one end thereof to an adjacent end of second railway car body member.

The female connection member, in this prior art coupling arrangement, is rotatably engaged in a center plate bowl portion of the bolster member positioned intermediate the side frames of the railway track member. Such rotatable-type engagement is accomplished in a manner that is generally well known in the railway art. The outer end portion of the male connection member is disposed for relative movement, at the outer end portion of such female connection member.

A pin member is utilized in this coupling arrangement to connect the outer end portion of the male connection member within the cavity of such female connection member together thereby forming such substantially semi-permanent coupling. This pin member is positioned in a vertical plane. Additionally, this pin member is positioned in aligned apertures which are formed in each of such male connection member and such female connection member. It is of significance to note that, as is taught in this prior art reference, the aperture formed in such male connection member for receiving such pin member therein must be formed somewhat larger than such pin member itself. In this coupling arrangement, this is necessary to permit certain movements that are required of the coupling apparatus during service to be achieved.

It should additionally be noted that a rear surface portion of such apertures formed in such male connection member and which will receive such pin member therein includes a horizontally disposed concave configuration and a vertically disposed convex configuration. This particular configuration is desirable in this coupling arrangement in order for both the male connection member and the female connection member to be able to move in each of a horizontal direction and a vertical direction with respect to one another. Another substantial area of surface contact between the rear surface of such pin aperture and the pin member itself is provided by this configuration at the same time.

Such male connection member, adjacent the outer end surface of the outer end portion thereof, includes a convex configuration. This convex configuration on the outer end surface of such male connection member abuttingly engages a complementary concave surface which is formed on a front face portion of a follower member.

As illustrated, in this coupling arrangement, this follower member is disposed within the rear portion of such cavity located in the outer end portion of such female connection member. This follower member, on the rear face portion thereof, includes a pair of vertically disposed slot-like cavities formed therein. A first portion of a resilient member is positioned within each of these vertically disposed slot-like cavities. Each such resilient member includes a second portion which extends outwardly from the rear face portion of such follower member.

In this manner, a vertically disposed wedge-like element can be engaged with the exposed outermost surface area of each such resilient element. Such wedge-like element being a necessary component so that during service of this coupling arrangement such follower member and the male connection member can be urged forwardly. Consequently, the rear surface portion of the aperture formed in such outer end portion of the male connection member will be maintained substantially in mating engagement with such pin member at all times.

In this coupling arrangement, because the majority of the articulated connecting members used are normally manufactured as cast components, such mating engagement being maintained between such pin members and the rear surface portion of this aperture disposed in the male connection member is essential. Furthermore, in attempting to maintain the manufacturing costs of this coupling arrangement as low as possible, such cast connecting components will normally receive very little, if any, finish machining necessary to provide either the required or the desirable dimensional control. In other words, these cast connecting members will generally be used as cast. As a result of this manufacturing cost-saving practice, it is quite often difficult to provide an articulated coupling apparatus that will be self-adjusting under the various wear conditions which such coupling apparatus will normally be subjected to during operation. It is important, nevertheless, to minimize as much as possible the slack encountered in the various coupling connections during such in track service.

Other prior art type coupling devices are taught U.S. Pat. No. 3,716,148 and Canadian Patent Number 1,231,078.

SUMMARY OF THE INVENTION

Provided by the present invention is a locking wedge assembly for removably securing a male connection member of an articulated-type coupling arrangement to a female connection member of such arrangement. Such articulated-type coupling arrangement being used to connect one end of a first railway car to an adjacently disposed end of a second railway car in a substantially semi-permanent manner. The locking wedge assembly is capable of exerting a constant predetermined pressure in at least one direction during use. Such locking wedge assembly comprises at least one wedge-shaped member, a bolt member and at least one force exerting means. Such at least one wedge-shaped member includes a first substantially flat surface which will matingly engage a substantially vertically disposed and flat surface located in an opening formed in a side wall portion of a cavity that is disposed at the outer end portion of such female connection member during use of such locking wedge assembly. A substantially horizontally disposed bottom surface of such wedge-shaped member is positioned adjacent a bottom surface of such opening formed in the side wall portion of the cavity. Such wedge-shaped member also has a second substantially flat surface which is disposed substantially radially opposite such first surface. This second surface is matingly engageable with an angularly disposed substantially flat surface located on at least one shaft member of a spherical bearing assembly. Such spherical bearing assembly being carried by such male connection member. This second flat surface includes a tapered portion having a predetermined taper. Such tapered portion of the second flat surface extends upwardly from the bottom surface of such wedge-shaped member and outwardly from the longitudinal axis of such locking wedge assembly. A substantially horizontally disposed top surface of such wedge-shaped member is positioned substantially axially opposite the bottom surface thereof. Such wedge-shaped member has a pair of substantially vertically disposed side surfaces. There is an aperture formed through such wedge-shaped member substantially along the longitudinal axis thereof. Such aperture has both a predetermined size and a predetermined shape. The substantially vertically disposed bolt member is positioned through this aperture in the wedge-shaped member as well as through an aperture formed through a bottom wall portion disposed on the outer end portion of such female connection member adjacent such opening formed in such side wall portion of the cavity. The at least one force exerting means of such locking wedge assembly is disposed intermediate at least one of such top surface of the wedge-shaped member and a bottom surface of a head portion of such bolt member, and a bottom surface of such bottom wall portion adjacent such opening and a top surface of the nut portion of such bolt member. Such at least one force exerting means exerts a predetermined pressure on such wedge-shaped member at all times during use of such locking wedge assembly.

OBJECTS OF THE INVENTION

It is, therefore, one of the primary objects of the present invention to provide a locking wedge assembly for securing a male connection member to a female connection member of an articulated coupling arrangement which will ensure a substantially tight slack force connection will be maintained at all times.

Another object of the present invention is to provide a locking wedge assembly for securing a male connection member to a female connection member of an articulated coupling apparatus which will serve as a sacrificial component thereby protecting other more critical components.

Still another object of the present invention is to provide a locking wedge assembly for securing a male connection member to a female connection member of an articulated coupling apparatus which is relatively easy to install and maintain.

Yet another object of the present invention is to provide a locking wedge assembly for securing a male connection member to a female connection member of an articulated coupling apparatus which is relatively inexpensive to manufacture.

A further object of the present invention is to provide a locking wedge assembly for securing a male connection member to a female connection member of an articulated coupling apparatus which is capable of exerting a predetermined force in at least one direction during use.

In addition to the various objects and advantages of the locking wedge assembly described above various other objects and advantages of the present invention will become more readily apparent to those persons who are skilled in the railway coupling art from the following more detailed description of the invention, more particularly, when such description is taken in conjunction with the attached drawings and with the appended claims.

BRIEF DESCRIPTION OF THE DRAWING

FIG. 1 is a side elevational view, partially in cross-section, which illustrates a presently preferred embodiment of the invention.

FIG. 2 is a top view, partly in cross-section of apparatus shown in FIG. 1.

DETAILED DESCRIPTION OF THE INVENTION

It should be noted that the inventors named herein have invented a new and unique articulated-type coupling apparatus for use in joining two railway cars which serves the same function as the coupling apparatus disclosed in U.S. Pat. No. 4,258,628, Altherr, that patent being incorporated herein by reference. Unlike the prior art coupling apparatus of Altherr, however, the unique new coupling apparatus utilizes a spherical bearing assembly comprising a spherical bearing having a cylindrical shaft extending outwardly therefrom, which is the inner-connecting member between the male and female connection members. The new and unique articulated-type coupling apparatus is fully described in applicants' co-pending patent applications Ser. Nos. 07/520,581, 07/520,686, and 07/521,860 now U.S. Pat. Nos. 5,105,455, 5,131,331, 5,042,393, which are also incorporated herein by reference. While not limited thereto, this invention is addressed to a unique locking wedge assembly ideally suited for use with the unique new coupling apparatus of the above-noted applications, which is capable of exerting a predetermined force on the cylindrical shaft portion of the spherical bearing assembly in at least one direction to eliminate any slack between the cylindrical shaft and the female coupling member.

As is well known in the prior art, the male connecting member is insertable within a cavity in the female connecting member and secured in place by a locking pin. That is to say, the male member is provided with an aperture which extends diametrically through the body, and can be aligned with a pair of aligned apertures in opposed top and bottom wall portions of the cavity of the female member. Accordingly, the locking means, e.g., locking pin, is insertable through the aligned apertures to lock the male and female members together. The aperture through the male member is configured such that the male member is free to pivot about the locking means, e.g., locking pin, thereby provided the articulated coupling as desired. The walls of the cavity within the female member, must of course be sufficiently spaced from the male member to permit the pivotal motion and articulating action. Such coupling arrangements are very well known in the prior art, as disclosed in a substantial number of patents including U.S. Pat. No. 4,258,628, incorporated herein by reference.

Now refer more particularly to , FIGS. 1 and 2. Illustrated therein is a locking wedge assembly, generally designated 10. Such locking wedge assembly 10 is capable of exerting a predetermined pressure in at least one direction and is used to connect a male connection member 12 to a female connection member 14 of an articulated coupling arrangement. Such articulated coupling arrangement being used to connect one end of a first railway car to an adjacent end of a second railway car in a substantially semi-permanent fashion.

This locking wedge assembly 10 includes at least one wedge shaped member generally designated 20. Such wedge-shaped member 20 has a first substantially flat surface 16 which is matingly engageable with a substantially vertically-disposed and flat surface 18. This vertically-disposed flat surface 18 is located in an opening 22 formed in the side wall portion 24 of a cavity 26 disposed at an outer end 28 of such female connection member 14.

Further, the wedge-shaped member 20 has a substantially horizontally disposed bottom surface 30 positioned adjacent a bottom surface 32 of such opening 22 formed in such side wall portion 24 of the cavity 26.

Such wedge-shaped member 20 also has a second substantially flat surface 34 disposed substantially axially opposite such first surface 16. The second surface 34 of such locking wedge assembly 10 is matingly engageable with an angularly disposed substantially flat surface 36 located on at least one shaft member 38 of a spherical bearing assembly 40. Such spherical bearing assembly 40 being carried by such male connection member 12. This second flat surface 34 has a predetermined taper which extends upwardly from the bottom surface 30 and outwardly from the longitudinal axis of such wedge-shaped member 20.

Additionally, such wedge-shaped member 20 has a substantially horizontally disposed top surface 42 that is positioned substantially axially opposite such bottom surface 30.

The wedge-shaped member 20 also includes a pair of substantially vertically disposed side surfaces 44.

An aperture 46 is formed through the wedge-shaped member 20 substantially along the longitudinal axis thereof. Such aperture 46 has a predetermined size and a predetermined shape. The predetermined shape of the aperture 46 is preferably round and has a preferred diameter of at least about 1.05 inches. A preferred range of diameters for such aperture 46 will be between about 1.05 inches and about 1.075 inches.

The locking wedge assembly 10 also includes a substantially vertically disposed bolt member 48 positioned through such aperture 46 in the wedge-shaped member 20 and through an aperture 50 formed through a bottom wall portion 52 disposed on such outer end portion 28 of such female connection member 14 adjacent such opening 22 formed in the side wall portion 24 of such cavity 26.

Such locking wedge assembly 10 further includes at least one force exerting means, generally designated 60. Such force exerting means 60 is preferably a belleville washer 52 or the like and is disposed intermediate at least one of the top surface 42 of such wedge-shaped member 20 and a bottom surface 54 of a head portion of the bolt member 48, and a bottom surface 56 of such bottom wall portion 72 and a top surface 58 of a nut portion 62 of such bolt member 48. This force exerting means 60 exerts a predetermined pressure on such wedge-shaped member 20 at all times. This predetermined pressure will be at least about 2,000 psi. Preferably, such predetermined pressure will be between about 3,000 psi and about 4,000 psi and even more preferred, this pressure will be between about 3,600 psi and about 3,800 psi.

In a more preferred embodiment of the invention, the bottom surface 30 of such wedge-shaped member 20 includes a tapered portion 31 which extends outwardly from the first flat surface 16 and downwardly towards such second flat surface 34. The preferred taper being about 10 degrees.

In addition, the top surface 42 of the wedge-shaped member 20 is preferably provided with a chamfered portion around the perimeter of the aperture 46.

As can readily be seen from FIG. 1, the wedge-shaped member 20 will bias the shaft member 38 against the inward side of the shaft member aperture to maintain a slackless fitting. Removal of the wedge-shaped member 20, which is accomplished by removing bolt 46 and merely lifting wedge-shaped member 20 out of opening 22, will permit the coupling to be uncoupled.

In order to make the locking wedge assembly 10 a sacrificial component, each of such first and second flat surfaces 16 and 34, respectively, will have a hardness of between about 156 and 183 Brinell and such vertically disposed flat surface 18 located in the opening 22 formed in the side wall portion 24 of such cavity 26 and such angularly disposed flat surface 36 located on such at least one shaft member 38 will have a hardness of greater than about 185 Brinell.

Although a presently preferred locking wedge assembly for use in a articulated coupling arrangement has been illustrated in the drawing and described in detail above, it should be obvious that those persons who are skilled in the railway coupling art, that various other modifications and adaptations of the present invention can be made without departing from the spirit and scope of the appended claims.

We claim:

1. A locking wedge assembly, capable of exerting a predetermined pressure in at least one direction, for removably securing a male connection member to a female connection member of a articulated-type coupling arrangement used to connect one end of a first railway car to an adjacent end of a second railway car in a substantially semi-permanent fashion, said locking wedge assembly comprising:

(a) at least one wedge-shaped member, said wedge-shaped member including:

(i) a first substantially flat surface matingly engageable with a substantially vertically disposed and flat surface located in an opening formed in side wall portion of a cavity disposed at an outer end portion of such female connecting member, (ii) a substantially horizontally disposed bottom surface positioned adjacent a bottom surface of such opening formed in such side wall portion of such cavity, (iii) a second substantially flat surface disposed substantially radially opposite said first surface matingly engageable with and angularly disposed substantially flat surface located on at least one shaft member of a spherical bearing assembly carried by such male connection member, said second flat surface having a predetermined taper which extends upwardly from said bottom surface and outwardly from a longitudinal axis of said wedge-shaped member, (iv) a substantially horizontally disposed top surface positioned substantially axially opposite said bottom surface of said wedge-shaped member, (v) a pair of substantially vertically disposed side walls, and (vi) an aperture having a predetermined size and a predetermined shape formed through said wedge shaped member substantially along said longitudinal axis;

(b) a substantially vertically disposed bolt member positioned through said aperture in said wedge-shaped member and an aperture formed through a bottom wall portion disposed on such outer end of such female connection member adjacent such opening formed in such side wall portion of said cavity; and (c) at least one force exerting means disposed intermediate at least one of said top surfaces of said wedge-shaped member and a bottom surface of a head portion of said bolt member, and a bottom surface of such bottom wall portion and a top surface of a nut portion of said bold member for exerting a predetermined pressure on said wedge-shaped member.

2. A locking wedge assembly, according to claim 1, wherein said force exerting means is a Belleville washer.

3. A locking wedge assembly, according to claim 2, wherein said predetermined pressure exerted on said wedge-shaped member by said belleville-type washer is at least about 2,000 psi.

4. A locking wedge assembly, according to claim 3, wherein said predetermined pressure exerted on said wedge-shaped member by said belleville-type washer is between about 3,000 psi and about 4,000 psi.

5. A locking wedge assembly, according to claim 4, wherein said predetermined pressure exerted on said wedge-shaped member by said belleville-type washer is between about 3,600 psi and about 3,800 psi.

6. A locking wedge assembly, according to claim 5, wherein said belleville-type washer is disposed intermediate said top surface of said wedge-shaped member and said bottom surface of said head portion of said bolt member.

7. A locking wedge assembly, according to claim 1, wherein said predetermined shape of said aperture formed through said wedge-shaped member is generally round.

8. A locking wedge assembly, according to claim 7, wherein said predetermined size of said aperture formed through said wedge-shaped member is at least about 1.05 inches in diameter.

9. A locking wedge assembly, according to claim 8, wherein said predetermined size of said aperture formed through said wedge-shaped member is between about 1.05 inches and about 1.075 inches in diameter.

10. A locking wedge assembly, according to claim 6, wherein said predetermined shape of said aperture formed through said wedge-shaped member is round and said predetermined size of said aperture is between about 1.053 inches and about 1.073 inches in diameter.

11. A locking wedge assembly, according to claim 1, wherein said bottom surface of said wedge-shaped member includes a tapered portion which extends outwardly from said first flat surface and downwardly towards said second flat surface.

12. A locking wedge assembly, according to claim 11, wherein said tapered portion has a taper of about 10 degrees.

13. A locking wedge assembly, according to claim 6, wherein said bottom surface of said wedge-shaped member includes a tapered portion which extends outwardly from said first flat surface and downwardly towards said second flat surface, said tapered portion has a taper of about 10 degrees.

14. A locking wedge assembly, according to claim 1, wherein each of said first flat surface on said wedge-shaped member and said second flat surface on said wedge-shaped member has a hardness in a range of between about 156 Brinell and about 183 Brinell.

15. A locking wedge assembly, according to claim 1, wherein each of such vertically disposed flat surface located in such opening formed in such side wall portions of such cavity and such angularly disposed flat surface located on such at least one shaft member of such bearing assembly has a hardness greater than about 185 Brinell.

16. A locking wedge assembly, according to claim 6, wherein each of said first flat surface on said wedge-shaped member and said second flat surface on said wedge-shaped member has a hardness in a range of between about 156 Brinell and about 183 Brinell and each of such vertically disposed flat surface located in such opening formed in such side wall portion of such cavity and such angularly disposed flat surface located on such at least one shaft member of such bearing assembly has a hardness greater than about 185 Brinell, thereby making said wedge-shaped member a sacrificial component.

17. A locking wedge assembly, according to claim 10, wherein said top surface of said wedge-shaped member includes, a chamfered portion around a perimeter of said aperture.

18. A locking wedge assembly, according to claim 17, wherein said chamfered portion has a taper of about 45 degrees.

19. A locking wedge assembly, according to claim 18, wherein said chamfered portion extends downwardly from said top surface of said wedge-shaped member for a distance of about 0.063 inch.

20. A locking wedge assembly, according to claim 1, wherein said wedge-shaped member is a forging.

* * * * *

UNITED STATES PATENT AND TRADEMARK OFFICE

CERTIFICATE OF CORRECTION

PATENT NO. : 5,277,323

DATED : January 11, 1994

INVENTOR(S) : William D. Wallace et al.

It is certified that error appears in the above-indentified patent and that said Letters Patent is hereby corrected as shown below:

Column 2, line 10, please delete "only" first occurrence.
Column 6, line 25, please delete "provided" and insert --providing--;
column 6, line 34, please delete "," after to.
Column 8, line 55, please delete "bold" and insert "bolt".
Column 10, line 29, please delete "," after includes.

Signed and Sealed this

Seventeenth Day of May, 1994

*Attest:*

BRUCE LEHMAN

*Attesting Officer*

*Commissioner of Patents and Trademarks*